US012305412B2

(12) United States Patent
Martinez

(10) Patent No.: US 12,305,412 B2
(45) Date of Patent: May 20, 2025

(54) MONOLITHIC COLUMBARIUM UNIT

(71) Applicant: Trimontium Systems, Inc., San Franciso, CA (US)

(72) Inventor: Walter Andrew Martinez, San Franciso, CA (US)

(73) Assignee: Walter A Martinez

( * ) Notice: Subject to any disclaimer, the term of this patent is extended or adjusted under 35 U.S.C. 154(b) by 195 days.

(21) Appl. No.: 18/109,261

(22) Filed: Feb. 13, 2023

(65) Prior Publication Data

US 2024/0271454 A1 Aug. 15, 2024

(51) Int. Cl.
*E04H 13/00* (2006.01)

(52) U.S. Cl.
CPC ..... *E04H 13/006* (2013.01); *E04H 13/003* (2013.01); *E04H 13/008* (2013.01)

(58) Field of Classification Search
CPC .... E04H 13/006; E04H 13/003; E04H 13/008
See application file for complete search history.

(56) References Cited

U.S. PATENT DOCUMENTS 1,373,014 A * 3/1921 Moore ..... G09F 3/00 27/1
2,075,859 A * 4/1937 Martin ..... E04H 13/003 52/103
3,183,574 A * 5/1965 Diem ..... E04H 13/006 211/84
5,740,637 A * 4/1998 Snow ..... E04H 13/006 52/603
5,894,699 A * 4/1999 Fulton ..... E04H 13/006 52/134
6,105,315 A * 8/2000 Stoecklein ..... E04H 13/006 52/439
6,161,268 A * 12/2000 Joseph ..... E04H 13/006 27/35
6,167,600 B1 * 1/2001 Williams ..... E04H 13/006 27/35
7,243,405 B1 * 7/2007 Green ..... A61G 17/0136 27/35
9,625,144 B2 * 4/2017 Lynch ..... F21V 35/00
2022/0018150 A1 * 1/2022 Conrad, Jr. ..... E04H 13/006
2024/0093527 A1 * 3/2024 Bautz ..... E04H 13/008

* cited by examiner

*Primary Examiner* — Brent W Herring

(57) ABSTRACT

System and for interment of cremated remains with module above-ground columbariums. Columbariums are formed from either a monolithic block of stone or individual blocks that are stacked on top of each other. Spacers may be used between adjacent blocks in the vertical stack to enable two adjacent units to be interleaved. Support rods may extend through interleaved portions to enable adjacent units to be rotated with respect to each other as well as penetrating down into a below-ground foundation to provide resistance to overturning. Modularity may be achieved at the single-block level where each block contains only one niche, minimizing the capital expenditure operators must make to increase capacity for the facility. A separate six-sided columnar columbarium unit may also be provided with faces that alternate between pairs of drilled niches and corresponding memorials. Multiple layers of this may be stacked vertically together. Water or other fluid may flow up through a channel within the vertical column, exiting the top and flowing down over the faces into a catchment basin below where it is captured and recirculated.

17 Claims, 19 Drawing Sheets

MONOLITHIC COLUMBARIUM UNIT

BACKGROUND OF THE INVENTION

Columbariums for storing cremated and casketed human remains are known in the art. In the current marketplace, these items are built primarily for the convenience and profit of the manufacturer and not for the memorial park operator, church, cemetery operator or other facility operators (referred to generally herein as, "operators"). As a result, they tend to be metal modules with stone or other ornamental veneers. Although this sounds like it may save money it typically does not. Instead, it enable manufactures to sell specialized products with high profit margins the requires large, multi-unit purchases be made at once with many internal metal components and stone veneer surfaces. As a result, operators have to buy larger units then they typically need in order the complete the unit and tie up their capital for decades until those larger structures are sold to consumers. In other words, those larger structures, which must be purchased as a single unit, will sit empty until each unit is sold. This forces operators to forgo capacity or become cash-strapped until they are able to sell the individual units. Because death rates remain relative constant, incoming revenue for operators tends to be steady and predictable while expenses for capacity are not.

The inventor of this disclosure has been in the funeral and cemetery business for more than thirty years. In that time certain trends have emerged. First, the industry has moved towards cremation. Although casketed burials still happen, this business has shrunk in size while cremations have skyrocketed. Second, although demand has increased, creative has remained flat. Even today, interment options for cremations look visually clustered, plain, and in some cases, even cheap. Attempts to incorporate natural elements have fallen flat—there are even so-called natural stone columbariums that made from fiberglass boulders, something better suited for an amusement park. In some cases, granite interment boulders are available but the only memorialization options are to purchase circular bronze plaques from the same suppliers who dominate the memorialization industry. This unnecessary ties the operator to the supplier and results in a waste of metals, which detract from rather than embellish the beauty of natural stone. Unlike natural materials, metals like bronze tend to look worse after years of tarnishing. Add to this list, the all too prevalent columbarium of any size parallelogram which basically looks like a rectangular grid of 12×12 squares which may look somewhat attractive when first installed but eventually looks more and more clustered with names, dates, and epitaphs, especially when done with bronze plaques or lettering. Such columbariums are often made of a cheap, proprietary internal frame with natural stone veneer sheets attached to the outside. Moreover, the fabrication of these columbaria is no small task for operators. Because of their large size and heavy weight, they are often made in part offsite and then shipped in sections to the operator facility. Once they arrive, they must be delivered and offloaded with the assistance of heavy equipment and sometimes a crane. Other models must be welded onsite to join the above-ground metal portions to the reinforced steel foundation, and then faced by a stone mason with a stone veneer. The inner workings of these many units are surprisingly cheap, prone to rust and oxidation, and often even sloppy. Today, most cemeteries are low on capacity. In part because most are decades old and have filled up, but also because when considering the high cost of permitting, transportation, unloading, installation, and stone finishing of conventional columbarium options, they try to defer these costs as long as possible. Then, when they do finally order additional capacity, they are often pressured into ordering more than one columbarium unit to try to spread some of these fixed costs of delivery and installation across more units. The result is that they end up purchasing too much capacity and tying up too much capital into installations that may take decades to recoup their costs on, leaving them out of money until individual sale are made.

Thus, based on three decades of close observation, the inventor of this application believes that there is a need in the current marketplace for alternatives to the existing reality for the development of cremation inventory for cemetery operators that ameliorates some or all of these problems of existing solutions. There is a need for creative options made of natural stone whose elegance will withstand the test of time while providing modular designs that can break up lines, fit around corners, and provide a sense of movement, that may be easily modified to fit any height or length, to account for visibility, and to provide an aesthetic that compliments rather than detracts from the character of the memorial facility. In particular, there is a need for modular units that can be ordered at almost any scale, even one at a time, or in large orders, and that can be easily incremented as the operator's demand and budget allow. These designs should seek to merge the elegance of longevity of ancient cultures with the modern, innovative and pragmatic design to make them aesthetically and financially attractive to operators while decoupling them from making large capital investments with a small number of industry dominating suppliers.

SUMMARY OF THE INVENTION

In various exemplary embodiments, the prevent invention provides a modular above-ground columbarium system for interment of cremated human remains. In various embodiments, the system comprises monolithic sections made from a single block of stone with niches carved out of one side and corresponding memorials carved into the other side.

In various exemplary embodiments, the present invention provides a modular above-ground columbarium unit for interment of cremated human remains comprised of individual stacked blocks of stone of alternating length that can be free standing or interleaved with an adjacent unit. In various embodiments, niches are drilled into one side of each block with corresponding memorials on the opposing side.

In various exemplary embodiments, the prevent invention provides a modular above-ground columbarium unit for interment of cremated human remains comprised of individual blocks of stone stacked with spacers between them and interleaved with adjacent blocks to create an interconnected modular above-ground interment unit with large, geometric spaces throughout that enable viewing completely through the interconnected units as well as angular adjustment between them. In various embodiments, one side of each block will have niches drilled into it while the opposing side has memorialization text carved into it.

In still further exemplary embodiments, the present invention provides a multi-sided columnar interment unit, with faces that alternate between a pair of pre-drilled niches and corresponding memorialization plaques or carvings. Memorializations may be carved directly into the face of the columnar unit, alternatively on plaques or stone inserts attached to the face of the columnar unit. In various embodiments, the multi-sided columnar interment unit has a central passage extending from the top to the foundation that is connected to a fluid pump. The pump may pump water or other fluid up through the passage and out of the upper end of the unit so that it runs down one or more faces of the unit. A catchment basin proximate to a foundation of the unit may catch fluid after it runs down one or more faces of the unit so that it can be recirculated through the passage by the pump.

In yet other exemplary embodiments, the present invention provides a fully modular above-ground columbarium for interment of cremated human remains that consists of individual elongated blocks, each block having a niche carved into one face on one long end, and a memorial carved into the opposing face at the other long end. A transverse hole drilled from the top of the block through the bottom is used to position the block relative to other blocks when a support rod is inserted through the hole.

These and other embodiments of the present invention will be more fully appreciated with reference to the detailed description that follows and the accompany drawings where like reference numbers are used to refer to like structures.

DETAILED DESCRIPTION

The following description is intended to convey a thorough understanding of the embodiments described by providing a number of specific embodiments and details related to above ground modular and monolithic columbariums for storing cremated remains such as human remains at a memorial park or other facility. It should be appreciated, however, that the present invention is not limited to these specific embodiments and details, which are exemplary only. It is further understood that one possessing ordinary skill in the art in light of known systems and methods, would appreciate the use of the invention for all of its intended purpose.

Figure 1A:
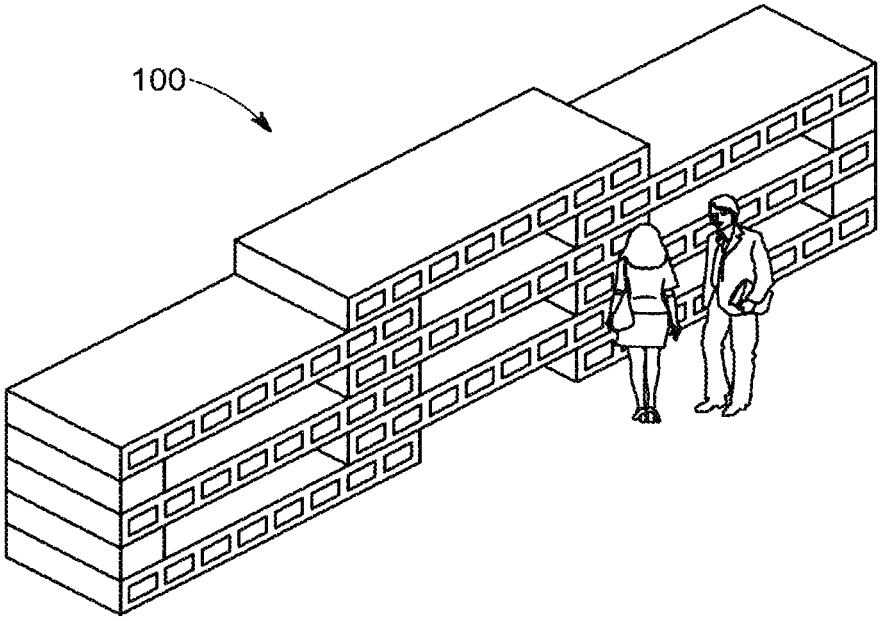
FIGS. 1A and 1B are front and back perspective renderings respectively of an above-ground columbarium unit for interment of cremated remains according to various exemplary embodiments of the invention.
Figure 1B:
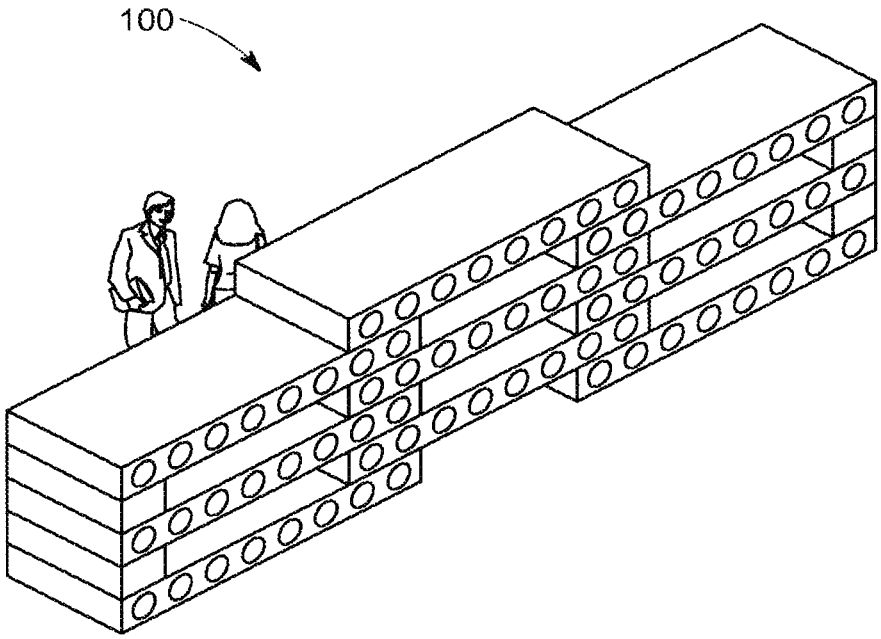

Turning now to the Figures, FIGS. 1A and 1B show front and rear perspective renderings respectively of an above-ground modular columbarium unit 100 for interment of cremated remains according to various exemplary embodiments of the invention. The columbarium 100 shown in FIGS. 1A and 1B may be located at a cemetery, memorial park, church, or other religious or secular facility where such remains are typically stored. Such facilities have been facing space constraints years, a problem that has been exacerbated by the relatively small number of new facilities being approved each year. Put simply, growth has not kept up with demand.

With continued reference to FIGS. 1A and 1B, visitors are shown standing in front of the front of modular unit 100. As shown in greater detail in the remaining figures, exemplary modular unit 100 is made from stacked layers of stone blocks having niches cut or drilled into one side (e.g., the back side) and memorials carved into the opposing side (e.g., front side). As shown, the niches have a circular cross section and are drilled partially through each stone on a regular schedule. Memorials may consist of names, dates, and other relevant identifying information and be positioned on a portion of each block roughly centered in front of a corresponding one of the niches. In the embodiment shown in FIGS. 1A and 1B, spacers are used to enable one section to be interleaved with an adjacent section. The spacers also create openings to enable visitors to be able to see through the modular unit across the property so that the units don't completely break up the visual aesthetic of the property.

Turning now to FIGS. 2 and 3A, 3B and 3C, these figures show above-ground modular columbarium unit 100 in greater detail including front perspective, top, back and side views respectively. Modular unit 100 is made from individual stacked sections 105, where each stacked section consists of blocks 110 and spacers 120. Spacers are used to vertically separate the blocks 110 on the outer edge of each stacked section 105. This enables both interleaving with adjacent sections 105 as well as creating geometric openings 125 that maintain visual continuity as a person looks through unit 100 across the property. If, as in the case of FIGS. 2, two or more sections 105 are interleaved together, spacers are only needed on the outside. If no adjacent sections 105 are included, then, spacers 125 will be used on both sides to provide vertical separation between stacked blocks 110. This may be commercially advantageous because it will reduce the size of the minimum module that may be purchased. In fact, the smallest commercially available unit may be a single block 110. Often the upfront expense of columbariums, which may take decades to recoup, prevents smaller operators from. As a result, these facilities, often running out of space and unable to purchase additional capacity, are teetering on the verge of financial insolvency.

Figure 2:
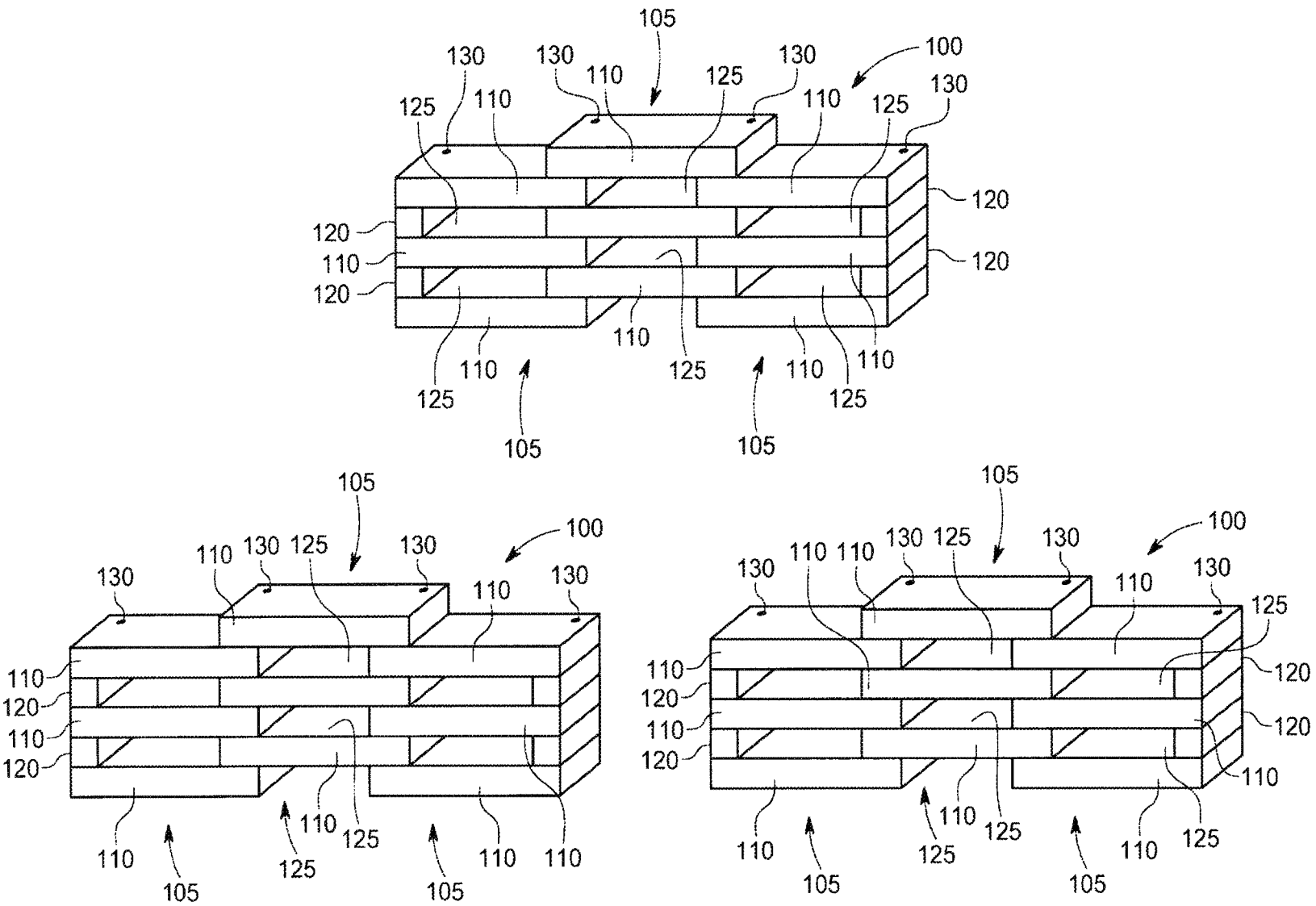
FIG. 2 is perspective view of multiple above-ground columbarium units shown in FIGS. 1A and 1B arranged at a memorialization facility according to various exemplary embodiments.

When multiple sections 105 are interleaved together, such as in the example of FIG. 2, the second adjacent section 105 starts on top of the lowest block 110 of the first section 105, effectively interleaving them. In various embodiments, spacers 120 are cut to the same thickness as blocks 110 to ensure that the stacked blocks are level, even after interleaving them with adjacent units. In various embodiments, a foundation such as foundation 50 is poured under modular columbarium 100 to provide level below ground support to the elevated structure. Foundation 50 may include rebar 55 as is well known in the art. In various embodiments, vertical support rods may extend down through each block 110 and spacer 120 of each section 105 into foundation 50 to prevent overturning. Individual blocks 110 and spacers 120 may be lowered down on to these support rods. Alternatively, the rods may be driven through them after the stack is formed. As seen in greater detail, for example, in FIG. 3C, support rods 132 may pass through each block 110 and spacer 120 down into foundation 50 while an epoxy plug 130 seals the top block to prevent the ingress of water into the shaft accommodating support rod 132.

Figure 4A:
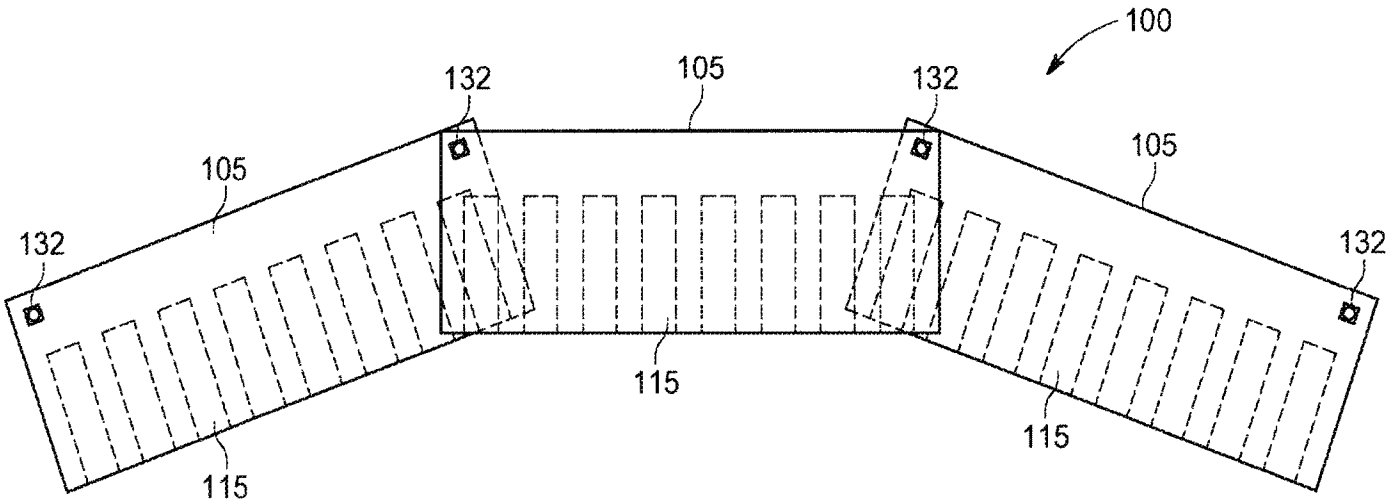
FIG. 4A is a top view of an array of interconnected above-ground columbarium units such as those shown in FIG. 2, at negative angles with respect to one another.
Figure 4B:
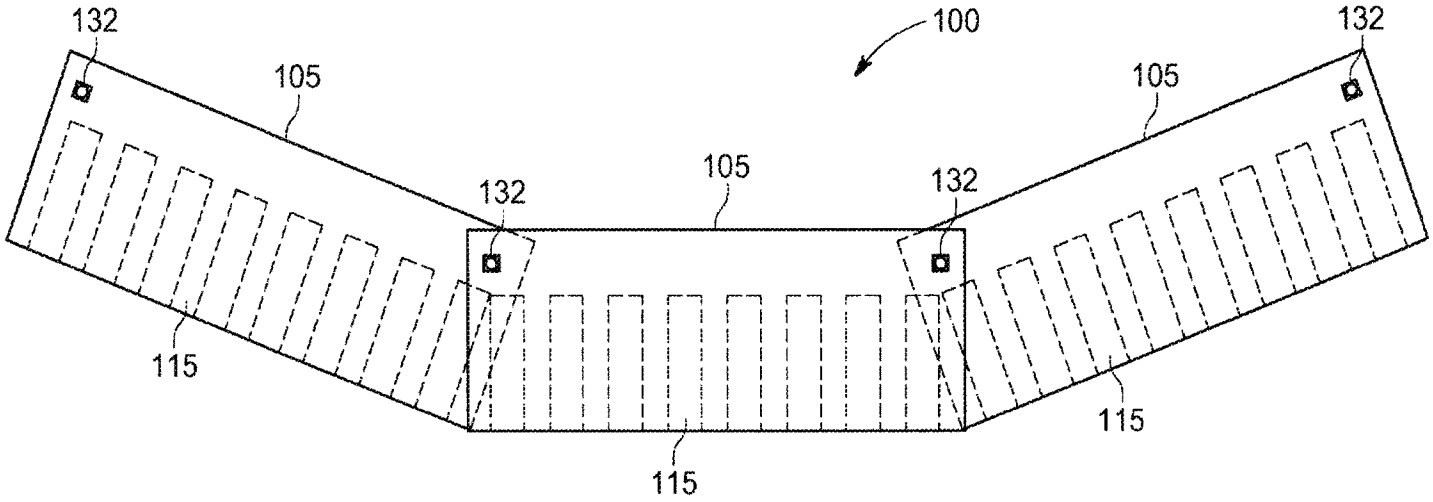
FIG. 4B is a top view of an array of interconnected above-ground columbarium units such as those shown in FIG. 2, at positive angles with respect to one another.

By interconnecting sections 105 from above and at the point of interleaving, support rods 132 may also enable a section 105 to be slightly rotated in plane, that is at a different angle when looking down from above, relative to an adjacent block. This may add to the overall design aesthetic. This is seen, for example, in FIGS. 4A and 4B. In 4A, the front side of each adjacent unit is rotated −20 degrees (i.e., outward) to enable the row created by three units 105 to curve. Similarly, in 4B, the front side of each adjacent unit is rotated +20 degree (i.e., inward). This may enable units 105 to curve around trees or other natural/existing features or may simply add to the overall design aesthetic depending on the layout of the facility.

Figure 3A:
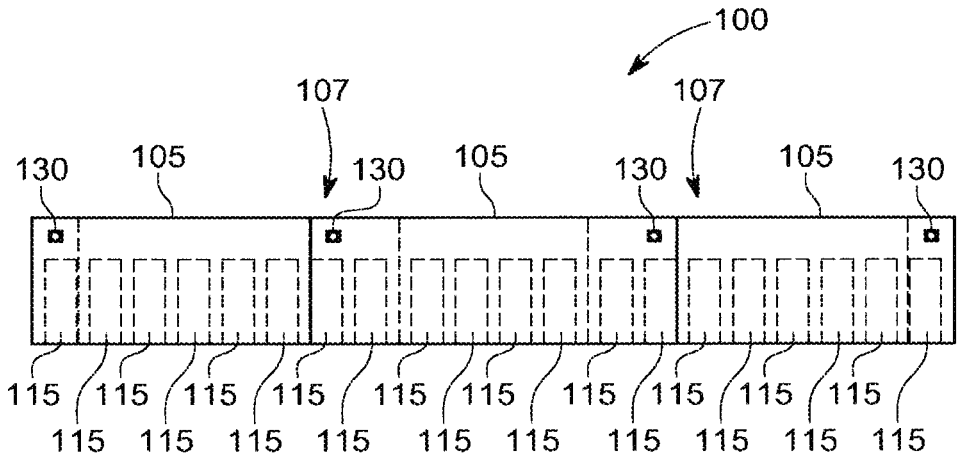
FIG. 3A is top view of one of the above-ground columbarium units shown in FIG. 2 according to various embodiments.
Figure 3B:
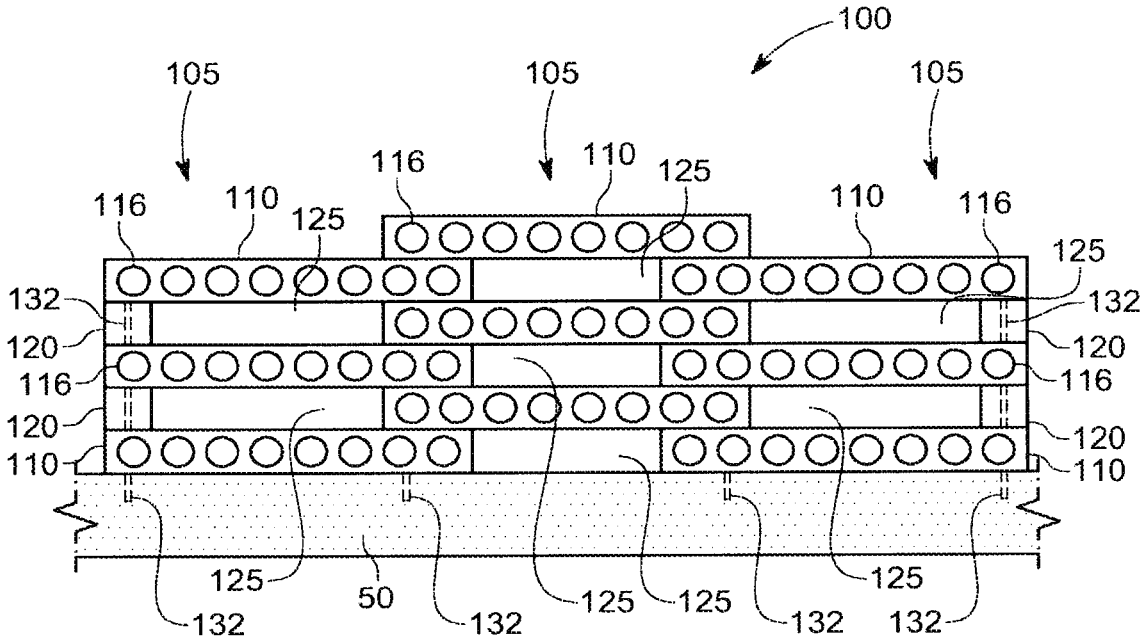
FIG. 3B is a back view of the above-ground columbarium units shown in FIG. 2 according to various embodiments.
Figure 3C:
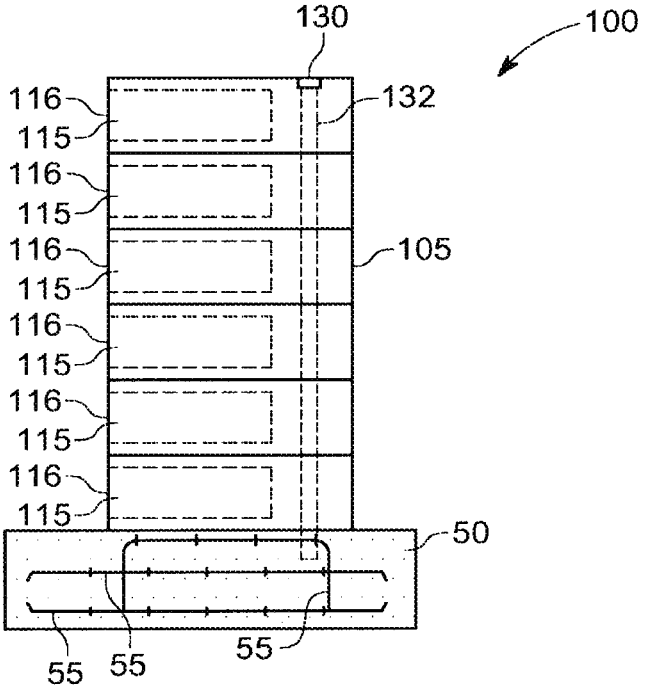
FIG. 3C is a side view of the above-ground columbarium units shown in FIG. 2 according to various embodiments.

Returning to the top back view of FIGS. 3A and 3B respectively, pre-drilled niches 115 have circular openings 116. These niches may be drilled to have a uniform internal diameter extending partially through each block 125 (e.g., ⅔ of the way through). In some embodiments it may be advantageous to make each niche opening 115 slightly larger in diameter than the remainder of the bore of the niche to accommodate an insert, plug, or cap over the niche opening, both prior to the niche being used to store cremated remains and after. This is shown and discussed in greater detail, for example, in the context of FIGS. 17A-D.

In some embodiments, niches may be covered with a blank plug until they are used and then covered with an ornamental one after use. In some embodiments, memorials may be carved directly into the front side of each block 105, while in others, a cutout may be carved at the location of each memorial, over each niche, that receives a carved stone insert that contains the memorial information. In this way, mistakes may be accommodated and/or changes may be made after interment, such as due to changes in family relationships or the need to relocated cremated remains. This is shown in greater detail, for example, in the context of FIGS. 15, 16A and B.

It should be appreciated that although FIGS. 1A, 1B, and 2 show three interconnected sections 105, that modular units 100 may be configured in any number of interconnected sections 105 or as single, free-standing sections. Such modifications are within the spirit and scope of the various embodiments of the invention.

Figure 5A:
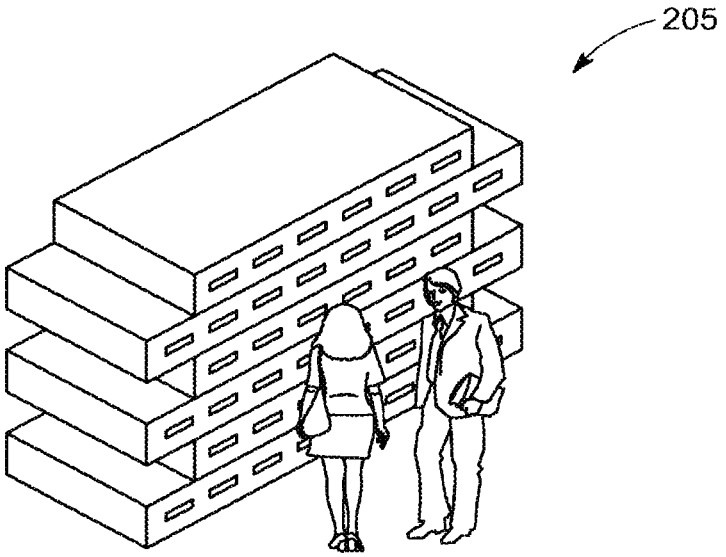
FIGS. 5A and 5B are front and back perspective views respectively of another above-ground columbarium unit for interment of cremated remains according to various exemplary embodiment of the invention.
Figure 5B:
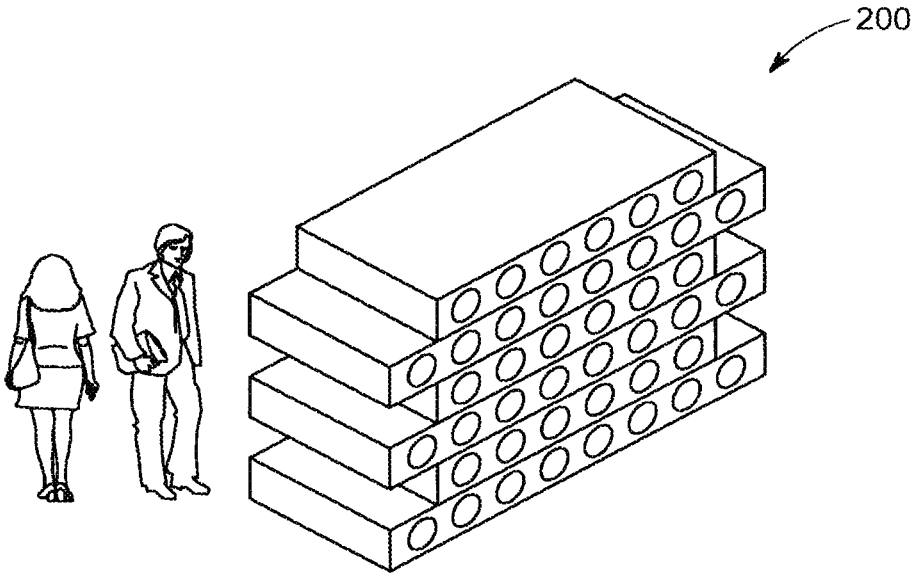
Figure 6:
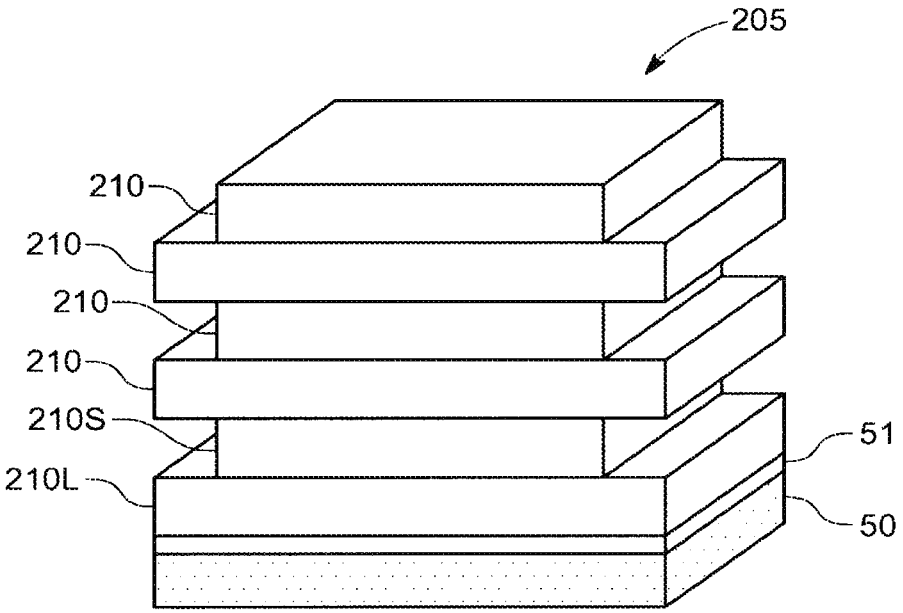
FIG. 6 is a front perspective view of a single offset above-ground columbarium unit according to various exemplary embodiments of the invention.

Turning now to FIGS. 5A and 5B, these figures show front and back perspective renderings of respectively of an another above-ground columbarium unit 205 for interment of cremated remains according to another various exemplary embodiments of the invention. Unit 205 shown in these figures is again situated at a cemetery, memorial park, church, or other facility where cremated remains are stored. Like unit 100 of FIGS. 1A and 1B, one side of unit 205 includes memorials while the other has pre-drilled niches that extend partially through each block. The memorials may be carved directly into the face of the stone block. Alternatively, a tile or other stone piece may fit into a recess cut into the face of each stone above or in front of the niche. Niches may also remain covered with plus or inserts made of stone or other material to preserve them until use.

Turning to FIGS. 6 and 7A-7C, these figure show unit 205 of FIGS. 5A and B in greater detail. As shown, exemplary unit 205 is made up of stacked blocks 210. Unlike columbarium unit 100, in columbarium unit 205, spacers are not used. Instead, blocks 205 are stacked directly on top of one other. Also, in unit 205 shown in this example, adjacent stacked blocks alternate in size from, for example, from 6 niches to 8 niches, to create a stepped edge. In various embodiments, this may enable an unlimited number of such units 205 to be interleaved with one another forming an infinitely long row. Alternatively, units 205 may stand alone. In the case of interleaved adjacent units, if the first unit starts with a long block 210L on the bottom, the next adjacent unit will start with a short block on the bottom 210S. Alternatively, both may start with long block 210L on the bottom to create openings to enable a viewer to see in between adjacent units 205. As shown in FIG. 5, unit 205 sits on a poured concrete foundation 50 with rebar 55. Optionally, a water proof barrier or force spreading material 51 may sit between foundation 50 and the first block, in this case long block 210L of unit 205.

Figure 7A:
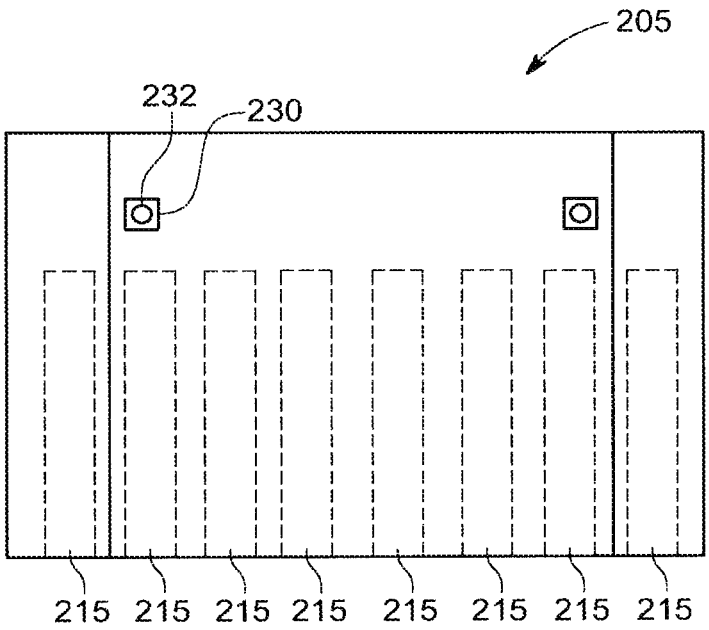
FIG. 7A is a top view of one of the above-ground columbarium units shown in FIG. 6 according to various exemplary embodiments.

Turning to the top view shown in FIG. 7A, niches 215 are drilled approximately ⅔ of the way through each block. Vertical support rods 232 lock each block together via vertical bore hole extending through each block down into foundation 50. Again, blocks 210 may be lowered onto the support rods, or, alternatively, support rods may be driven through them after blocks 210 are stacked. As with other embodiments, support rod 232 may be covered with epoxy or other suitable material 230 to prevent the ingress of water into the borehole. As shown in the rear view of FIG. 6B, each niche 215 has an opening 215 that may be covered with a cover or plug both before and after use to keep rodents and other creatures from nesting inside. Because interleaved sections of longer blocks 210L are cantilevered, adjacent units 205 may be placed flush, positioned at an angle from an overhead perspective, or at the same angle but staggered in front of in back of the next adjacent unit.

Figure 7B:
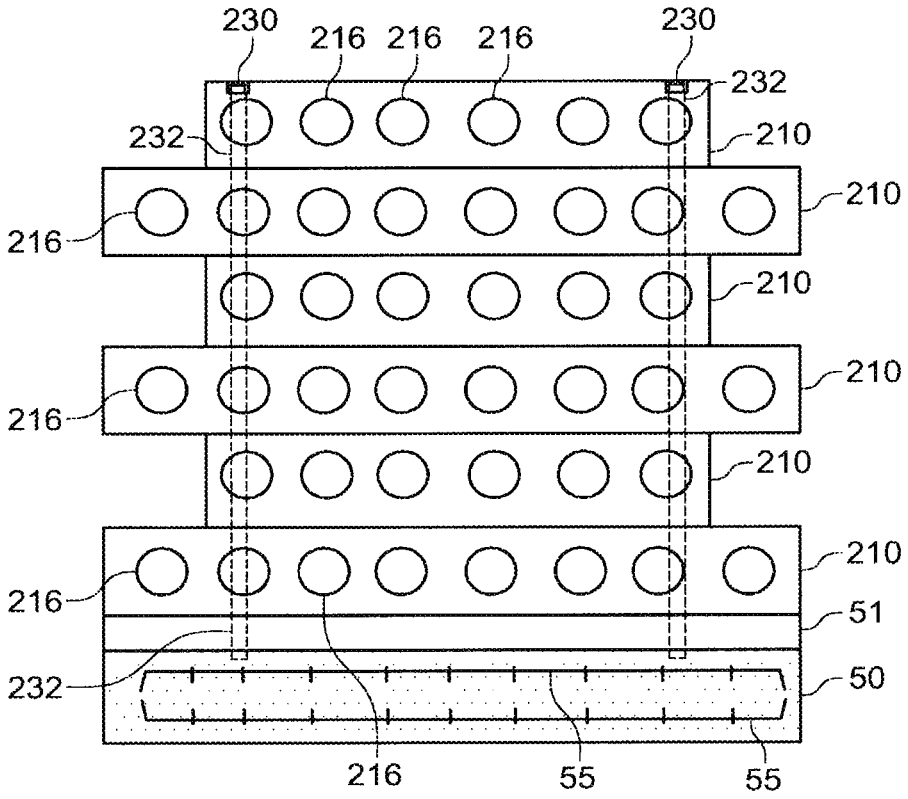
FIG. 7B is a rear view of the above-ground columbarium units shown in FIG. 6 according to various exemplary embodiments.
Figure 7C:
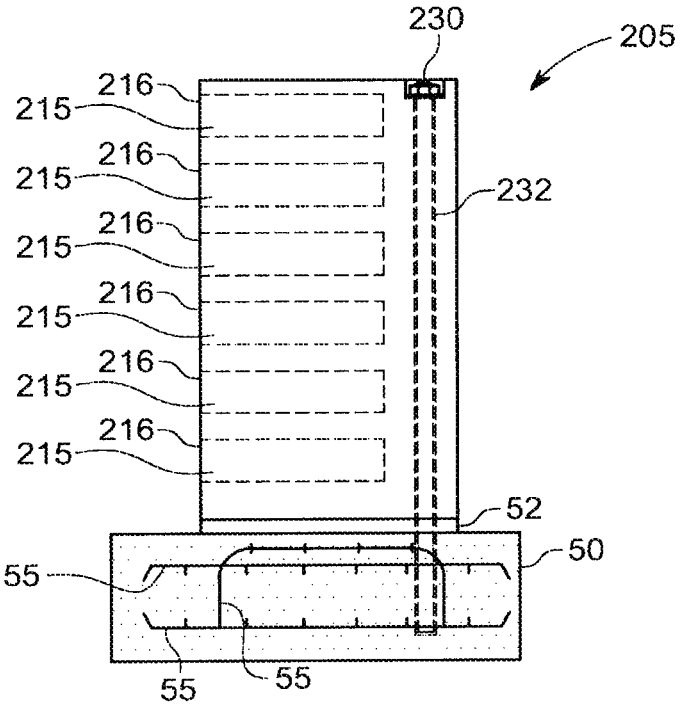
FIG. 7C is a side view of the one of the above-ground columbarium units shown in FIG. 5 according to various embodiments.

FIG. 7B shows that vertical support rods 232 extend through blocks 210 in way that enables each unit 205 to be free standing with respect to another adjacent unit. It should be appreciated that although the unit shown in FIGS. 5A, 5B, 6 and 7B consist of six layers of blocks 210, that a different number may be used. Alternatively, adjacent units 205 may be constructed from a different number of blocks 210 to create an architectural affect like a sculpture garden where units are intentionally incongruent.

Figure 8:
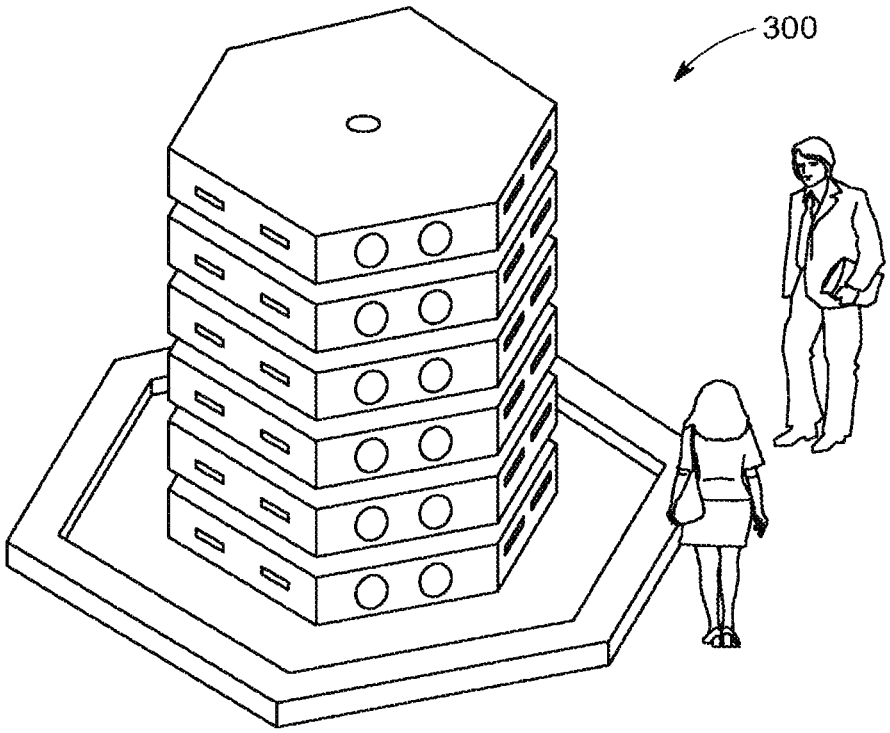
FIG. 8 is a rendering of an exemplary above-ground columnar columbarium unit for interment of cremated remains according to various exemplary embodiments of the invention.
Figure 9:
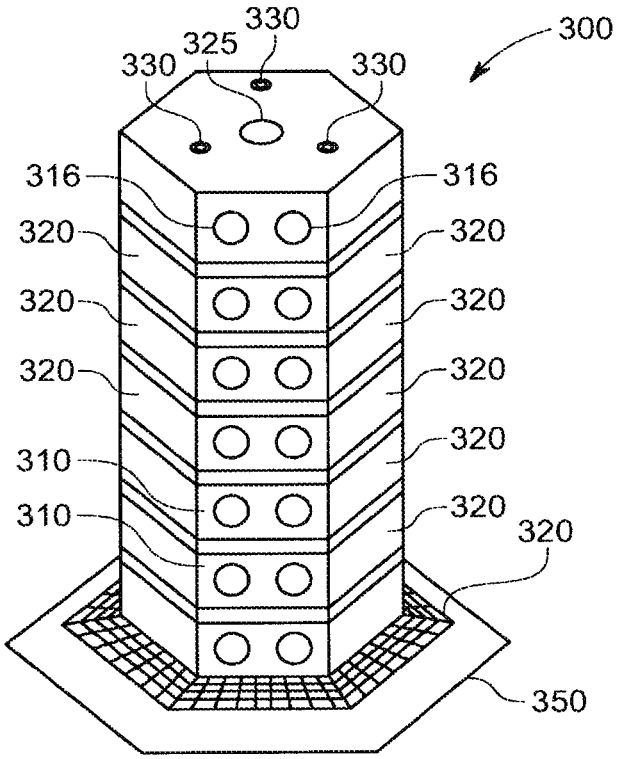
FIG. 9 is a perspective view of the exemplary above-ground columbarium unit for interment of cremated remains shown in FIG. 8.
Figure 10A:
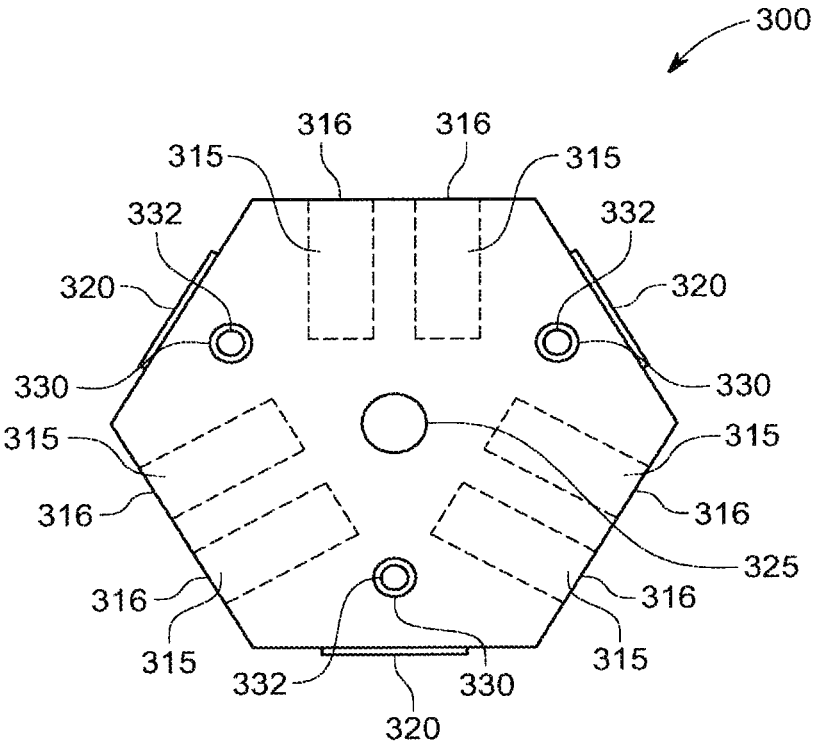
FIG. 10A is a top view of the exemplary above-ground columbarium unit for interment of cremated remains shown in FIG. 8.
Figure 10B:
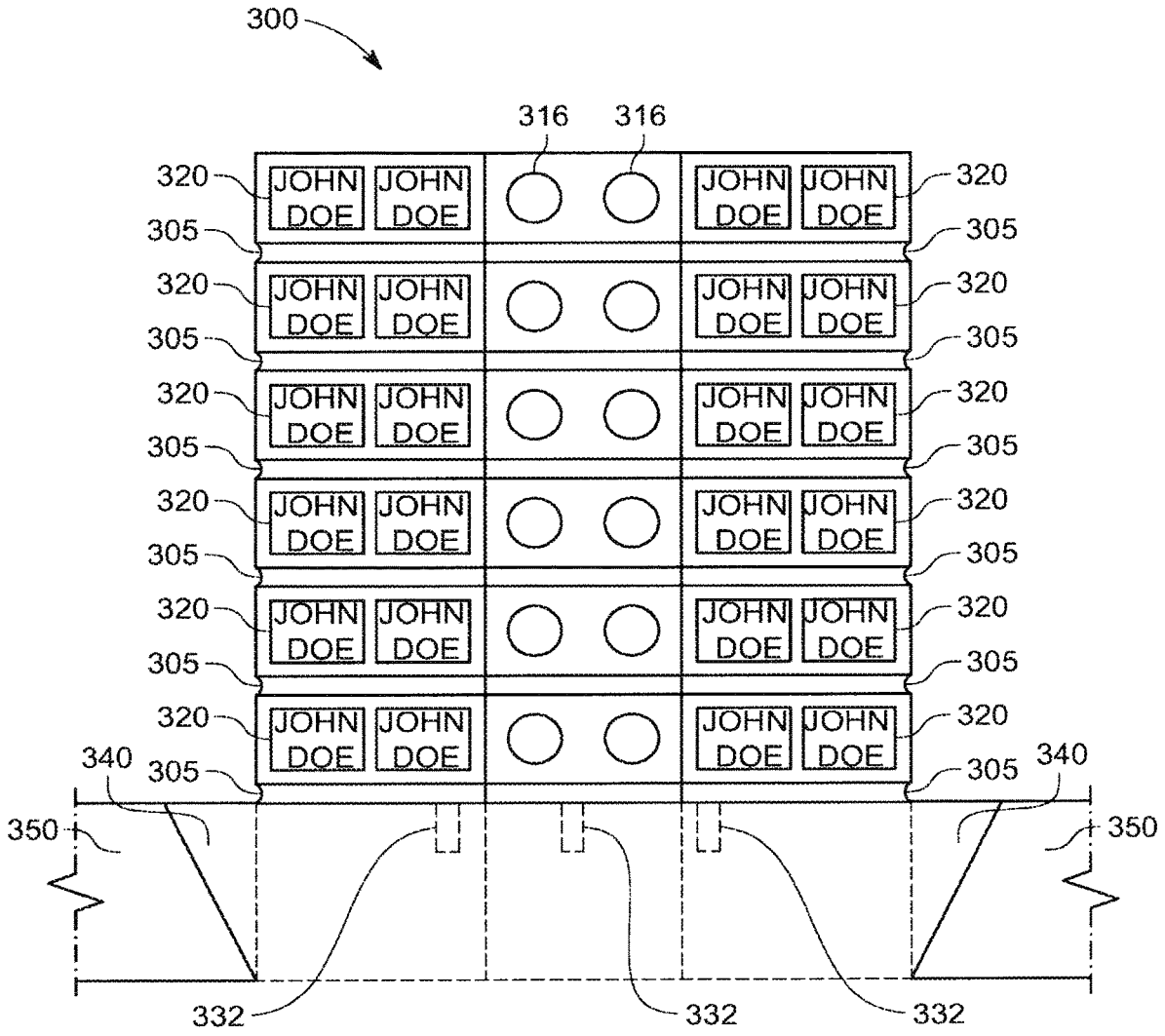
FIG. 10B is a front view of the exemplary above-ground columbarium unit for interment of cremated remains shown in FIG. 8.

Turning now to FIG. 8, this figure is a rendering of an above-ground columnar columbarium unit 300 for interment of cremated remains according to various exemplary embodiments of the invention. Unit 300 of FIG. 8 incorporates a water feature into the columbarium. As shown, unit 300 is a six-side column with a fountain emitting fluid from the top down one or more of the column faces. FIGS. 9, 10A and 10B show unit 300 in greater detail. As seen, for example, in FIGS. 9, 10A and 10B, the six faces of unit 300 alternate between memorials 320 and pre-drilled niches 315. Every other face has either two pre-drilled niches or two corresponding memorials. Unit 200 is constructed to looks like layers of this pattern are stacked vertically, preserving this orientation to make it look like a monolithic block of stone. In some embodiments, unit 300 may be cut form a single monolithic block with sections 310 divided by channels 305. In other embodiments, unit 300 may be constructed from individual six-sided blocks 310 stacked directly on top of one another. In various embodiments, one or more support rods 332 extend down through either the monolithic block or individual blocks 310 into a poured concrete foundation 350 below. Epoxy plugs 330 may be used to fill in the holes from the support rods to prevent the ingress of water in the column. Also, catchment basin 340 may be positioned around the foundation 350 to capture water or other fluid running out of the top of passage 325 down one or more the faces. In various embodiments, indentations (not shown) may be carved into the top surface of unit 300 to direct water to flow down a particular face or particular portion of the columnar unit until it reaches basin 340 where a recirculation pump recirculates it back up passage 325. In various embodiments, passage 325 may be predrilled. Then, a section of pipe or other tube is inserted into the passage to prevent water from leaking into the stone column where it could freeze and damage the column via expansion.

As shown in FIG. 10A, niches 315 may penetrate roughly ⅓ of the way through unit 300 so as to bypass one another as well as central fluid passage 325. Support rods 332 may extend down behind memorials 320 to avoid niches 315. As with other embodiments shown and discussed herein, niche openings 316 may be covered with stone plugs or other material both prior to use and after cremated remains are stored within them.

Figure 11A:
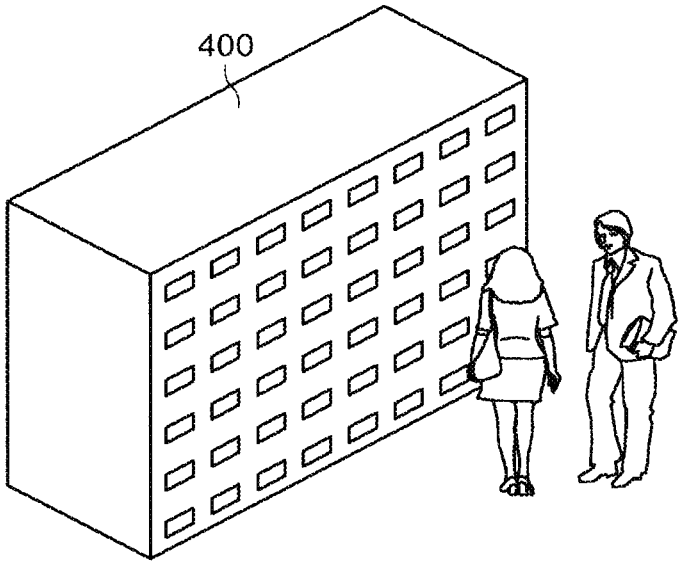
FIGS. 11A and 11B are front and rear renderings of an exemplary monolithic above-ground interment unit according to various embodiments of the invention.
Figure 11B:
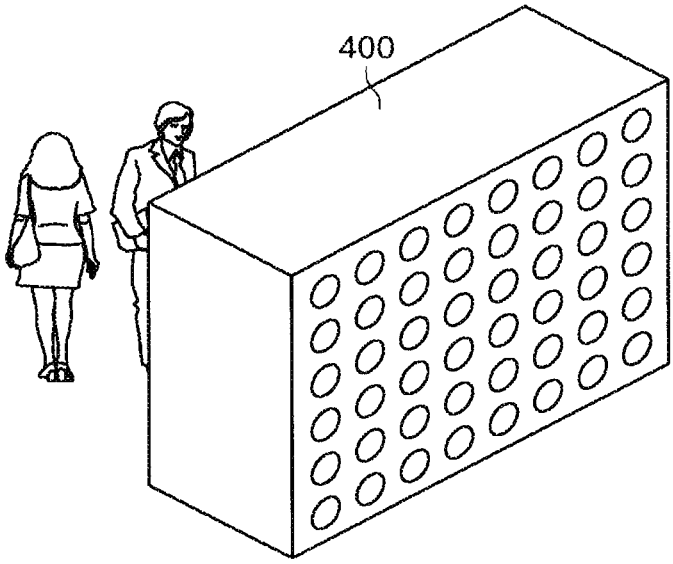

Turning now to FIGS. 11A and 11B, these figures show a rendering of a monolithic above-ground interment unit 400 made from a single block of stone according to various exemplary embodiments of the invention. In various embodiments, unit 400 may be made from single block of granite although other stone types may be used including marble, sandstone, travertine, limestone, or even colored concrete or other man-made, caste or 3D printed materials.

Figure 12:
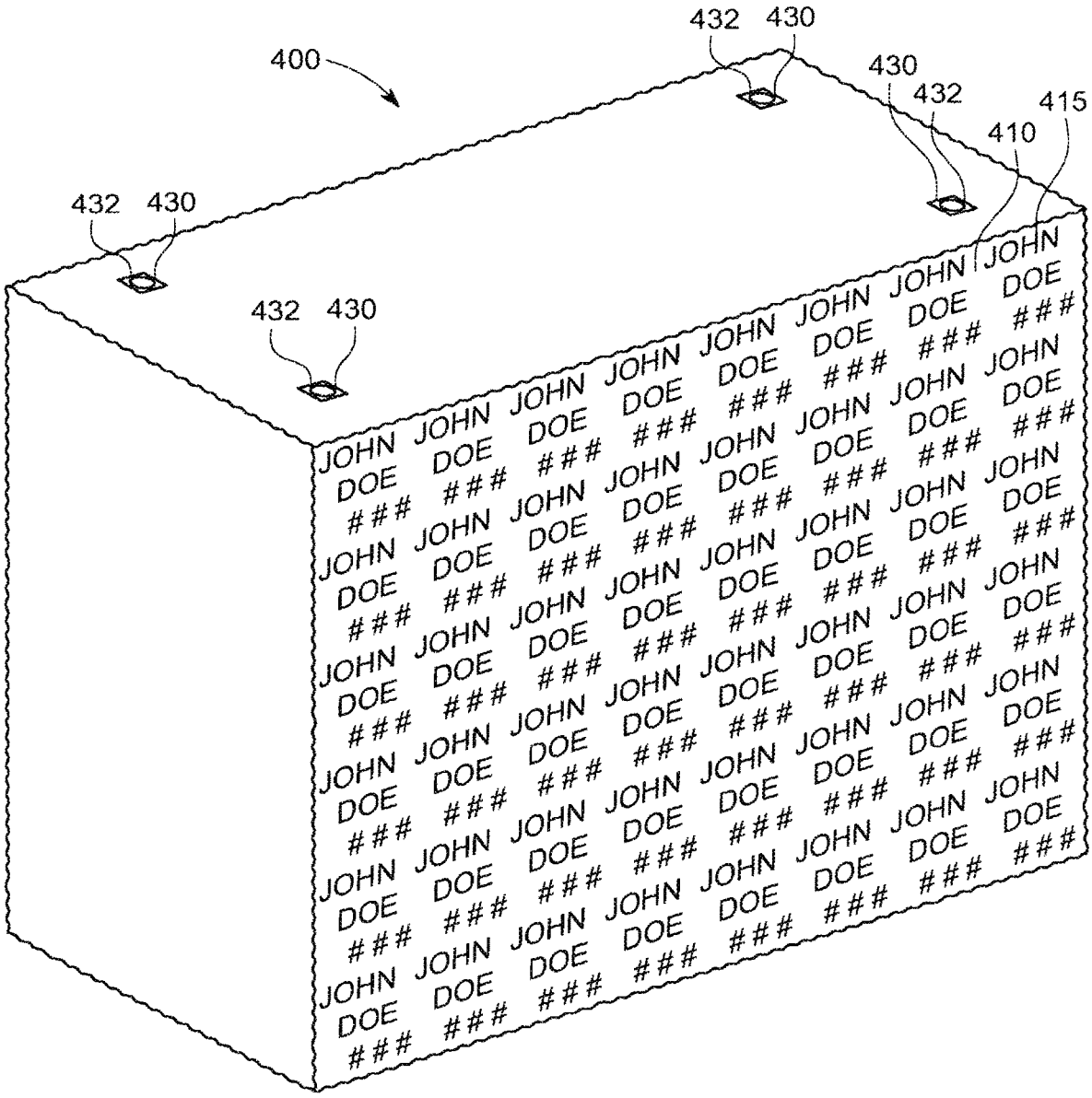
FIG. 12 is a front perspective view of the exemplary monolithic above-ground interment unit shown in FIGS. 11A and 11B.
Figure 13A:
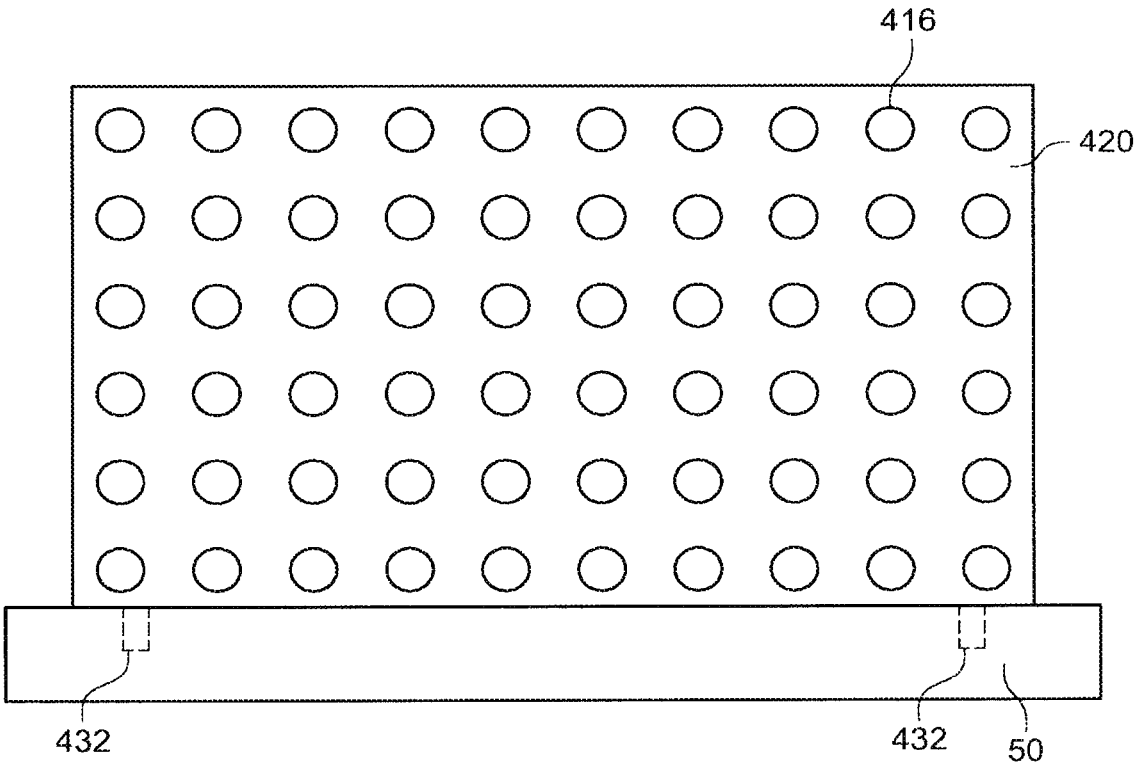
FIG. 13A is a rear view of the exemplary monolithic above-ground interment unit shown in FIGS. 11A and 11B.
Figure 13B:
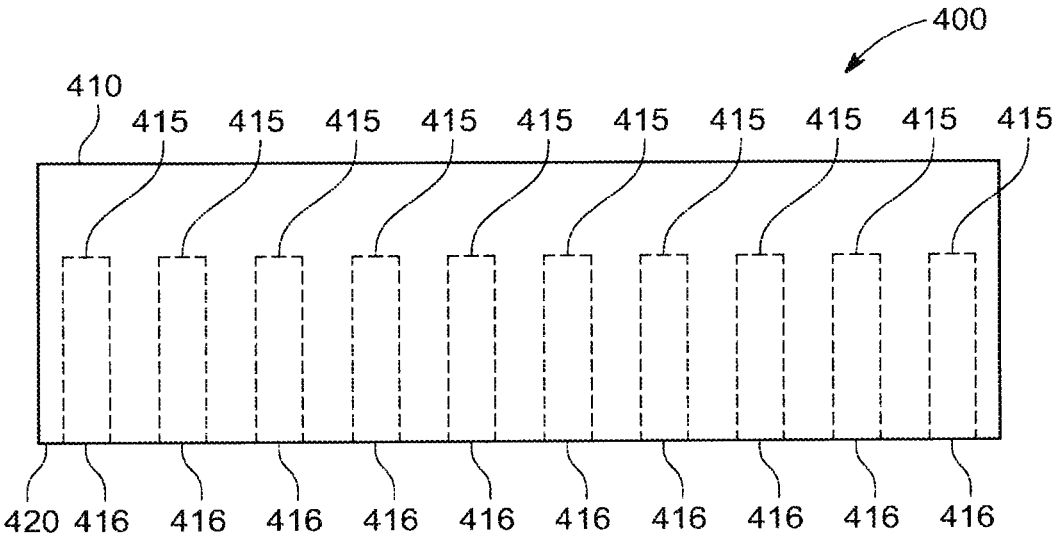
FIG. 13B is a top view of the exemplary monolithic above-ground interment unit shown in FIGS. 11A and 11B.

As with other columbarium embodiments shown and discussed herein, unit 400 has a front side and a rear side. The front side has memorials either etched directly into its face or attached as stone inserts into pre-cut openings. Rear side 420 contains pre-drilled niches 415 that receive containers holding cremated remains. These features are shown in greater detail in FIG. 12 and FIGS. 13A and 13B, providing front perspective, back and top views respectively. In the example of FIG. 12, memorials 415 are carved directly into the front face 410 of unit 500. As discussed herein in the context of other embodiments, precut holes may be formed in front face 410 of unit 400 that receive rectangular or square plugs containing the carved or raised memorial text. As shown, pre-drilled niches 416 are evenly distributed over the back face 420 of unit 400. It should be appreciated that niches 415 may be staggered in rows of having different numbers to maintain sufficient integrity to the monolithic block as necessary. In various embodiments, the pattern of memorials is adjusted to match the pattern of niches so that a memorial is in physical correspondence to the location of a pre-drilled niche. As seen in 13B, pre-drilled niches 415 extend more than half way through unit 400. In various embodiments, the opening of each niche 416 are covered with a plug or opening that keeps it clean before first use as well as protecting the contents after first use.

Figure 14A:
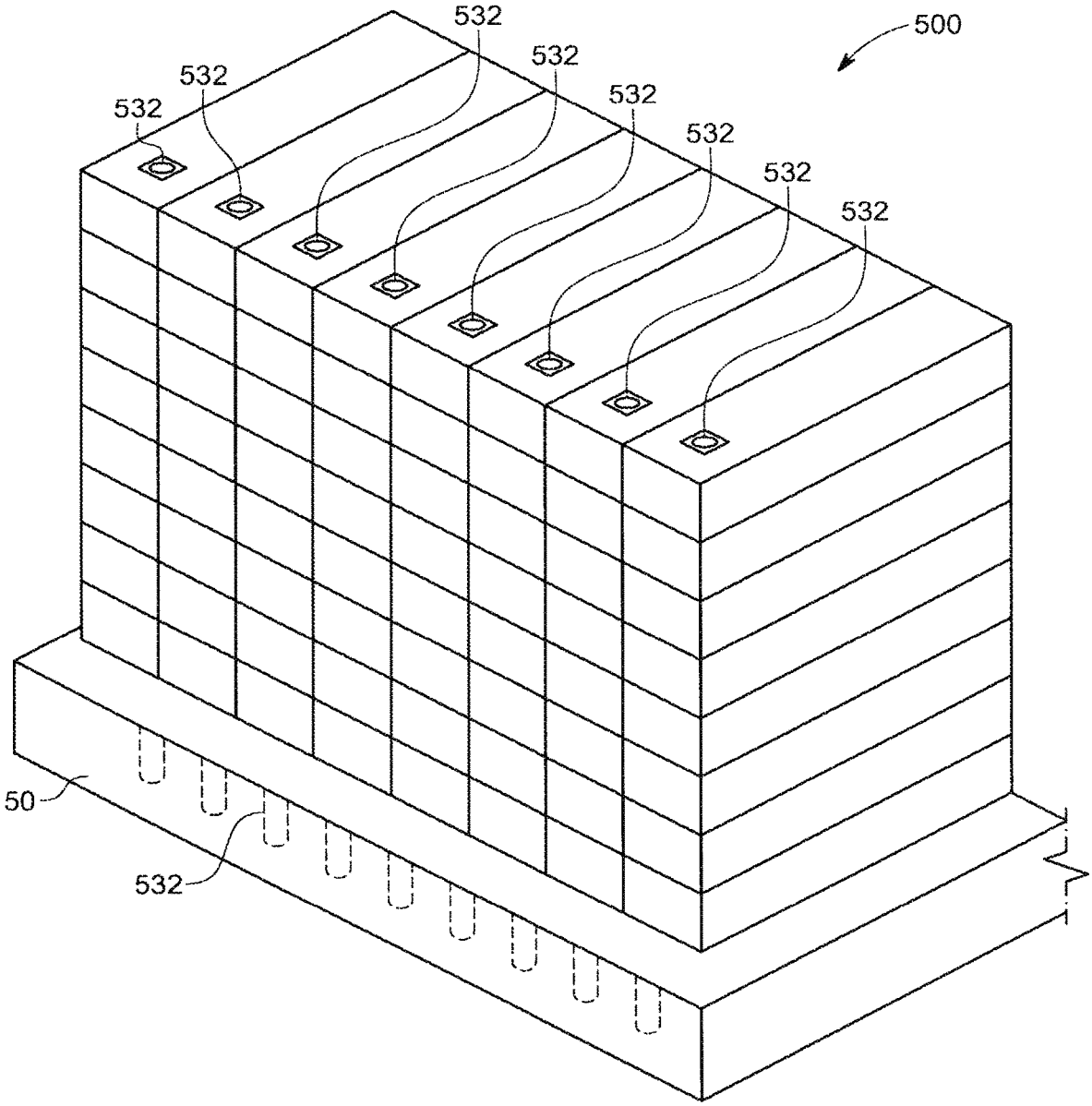
FIG. 14A is a front perspective view of yet another exemplary modular above-ground columbarium unit for interment of cremated remains according to various exemplary embodiments of the invention.
Figure 14B:
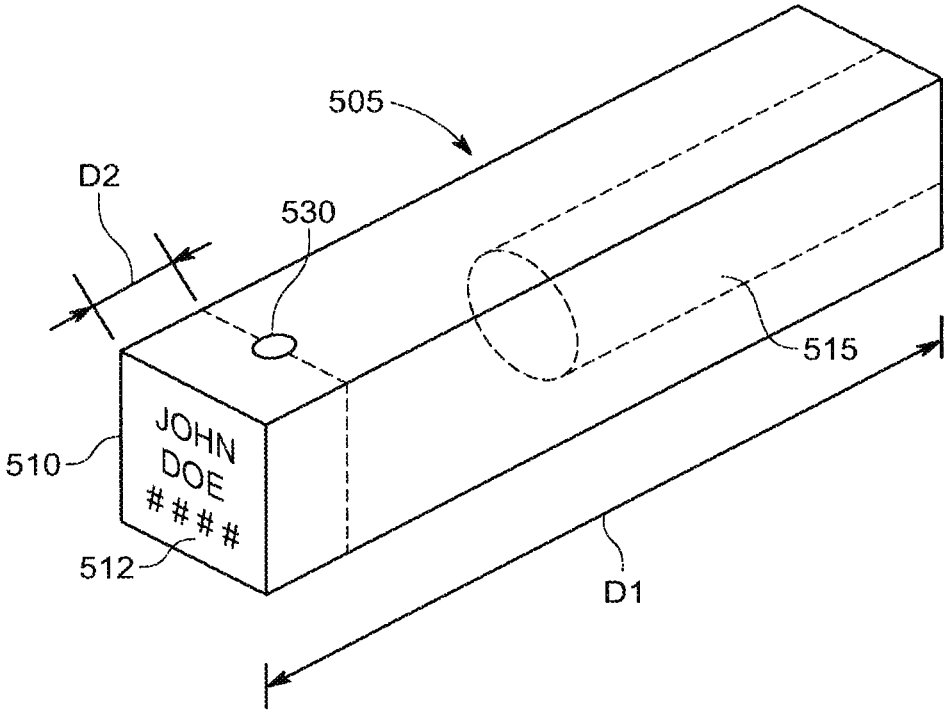
FIG. 14B is a front perspective view of an individual interment block of the exemplary modular above-ground columbarium unit shown in FIG. 14A.
Figure 14C:
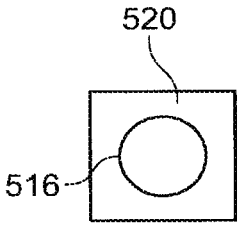
FIG. 14C is a rear view of the individual interment block of the exemplary modular above-ground columbarium unit shown in FIG. 14B.

Turning now to FIGS. 14A-C, these figures show another above-ground modular columbarium unit 500 according to various exemplary embodiments of the invention. The distinguishing feature of unit 500 relative to that of other embodiments shown and discussed herein is the level of modularity. In unit 500, the base unit is an individual interment block 505. In various embodiments, individual blocks 505 are of standard dimension, e.g., ¾' by ¾' by 3'. Each unit may have the same dimension $D_1$, that is, it length. Where adjacent units may vary is in dimension $D_2$, the distance from the memorial end to transverse opening 530. This distance may vary over a range of several inches and is constrained only by the location of niche 515. By varying distance $D_2$ among adjacent blocks 505, an offset effect will be created when the niche are stacked together and support rod 532 is passed through each block 505 of the stack. The memorial 512 of some blocks will appear to extend out of the plane of the memorial side while the memorials 512 of others will appear relatively recessed even though each has the same dimension $D_1$. Therefore, the blocks can be produced to be exactly the same with the only variation being the distance $D_2$ where the transverse through hole is drilled. In this manner, operators may literally order blocks 505 on an as-needed, one for one basis, adding to the unit 500 as needed. Alternatively the operator may order enough blocks 505 to fill a single column of the unit 500, thereby only needing to order increments of 8 rather than 50-150 as is common in the industry.

FIG. 14B shows block 505 in isolation in a front perspective view while 14C shows the same block 505 from the rear. As shown in these figures, pre-drilled niche 515 extending form opening 516 approximately halfway to two-thirds of the way through block 505. Memorial text 512 is carved directly into front side 510, although, it should be appreciated that text 515 may be a cap or other piece that simply attaches to the front of block 505. As with other embodiments, a plain or ornamental plug or cap may also cover pre-drilled niche opening 516.

Though not shown in any of the figure, it should be appreciated that in various embodiments, an urn or the receptacle may be provided that is dimensioned to fit inside the pre-drilled niches. Such an urn or receptacle may have an outside diameter that roughly matches the inside diameter of the niche. Also, although most urns are designed to sit upright, such as in a square or rectangular niche, or on a shelf, an urn optimized for the various embodiments of the present invention may instead of designed to sit on its side. Therefore, ornamental features may appear on the lid rather than on the side of the urn. Alternatively, a universal container may be provided that accepts a traditional urn and fits it into one of the pre-drilled niches. A detailed discussion of such urn is intentionally omitted here.

Figure 15:
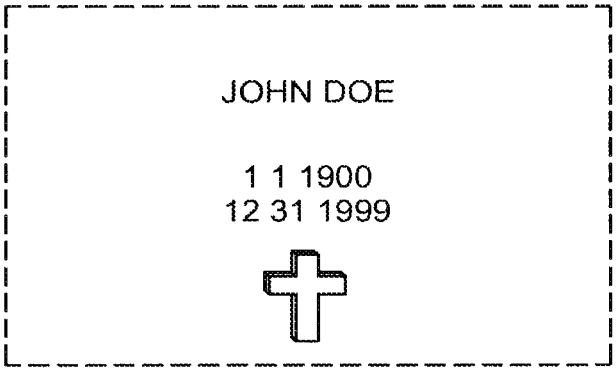
FIG. 15 is exemplary memorial text that may be used with any of the exemplary embodiments shown and discussed herein.
Figure 16A:
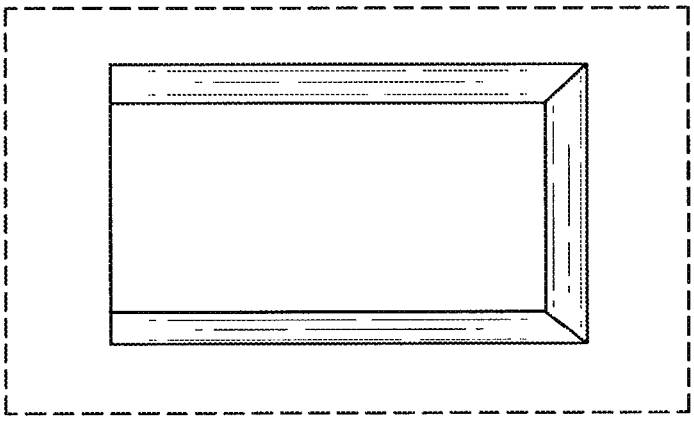
FIG. 16A is an exemplary recess for receiving a memorialization insert usable with any of the various exemplary embodiments of the invention shown and discussed herein.
Figure 16B:
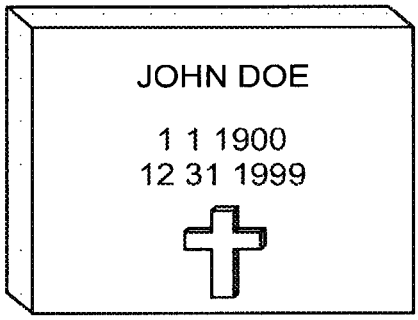
FIG. 16B is an exemplary memorialization insert usable with any of the various exemplary embodiments of the invention shown and discussed herein.

Turning now to FIG. 15, this figure shows exemplary memorial text that may be used with any of the various embodiments of the invention. Typically, a person's name as well as the year, and in some cases month and day of their birth and death are included. Sometimes symbols of religious affiliation are included (e.g., Christian cross, star of David, etc.), or other symbols (Freemasons, military designations, etc.). As discussed herein, such memorial language may in some cases be carved directly into the stone face of various columbariums. Alternatively at each memorial point, a recess may be carved into the face of the columbarium to accept a stone plug, where memorial language and symbols are instead carved into the plug. This is seen, for example, in FIGS. 16A and 16B. This may be advantageous because the plugs may be worked on at a central location and shipped rather than working directly on the stone block making up the columbarium. Also, mistakes and/or changes may be more easily accommodated using this process.

Figure 17A:
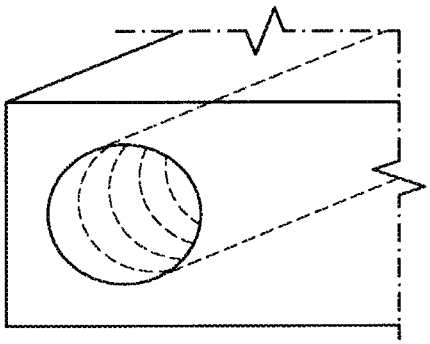
FIG. 17A shows an exemplary niche opening according to any of the various exemplary embodiments of the invention shown and discussed herein.
Figure 17B:
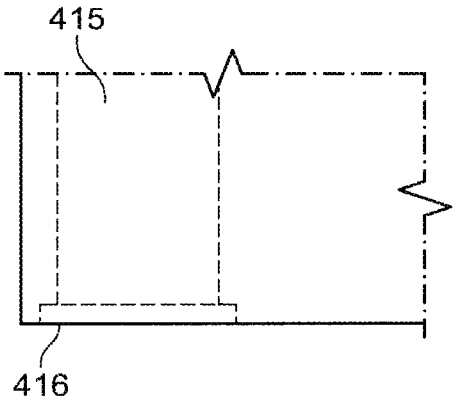
FIG. 17B is a top view of exemplary niche shown in FIG. 15A.
Figure 17C:
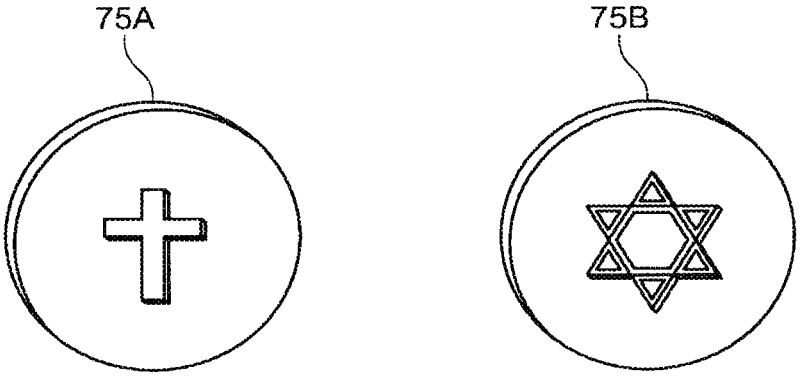
FIG. 17C shows a pair of exemplary niche covers usable with any of the various embodiments of the invention shown and discussed herein.

Similarly, as discussed herein, in various embodiments, openings for pre-drilled niches may be plugged with a blank plug made of stone, plastic or other suitable material. Once the niche is used to inter cremated remains, the opening may be filled with a customized plug or cover that is screwed or epoxied in place. Two such examples of plugs 75A and 75B are shown in FIG. 17B. Niche openings may be of the same diameter as the rest of the niche, such as seen in FIG. 17A. Alternatively, openings may have a slightly larger diameter such as opening 416 relative to niche 415 shown in FIG. 17B. The latter case may make it easier to glue or otherwise attach plugs 75A/75B into the opening by limiting the extent of penetration.

The embodiments of the present inventions are not to be limited in scope by the specific embodiments described herein. Indeed, various modifications of the embodiments of the present inventions, in addition to those described herein, will be apparent to those of ordinary skill in the art from the foregoing description and accompanying drawings. Thus, such modifications are intended to fall within the scope of the following appended claims. Further, although some of the embodiments of the present invention have been described herein in the context of a particular implementation in a particular environment for a particular purpose, those of ordinary skill in the art will recognize that its usefulness is not limited thereto and that the embodiments of the present inventions can be beneficially implemented in any number of environments for any number of purposes. Accordingly, the claims set forth below should be construed in view of the full breath and spirit of the embodiments of the present inventions as disclosed herein.

The invention claimed is:

1. A cemetery system comprising:

a plurality of interconnected above-ground columbarium units, wherein each above-ground columbarium unit comprises a plurality of stacked blocks of natural stone sitting on a foundation with a plurality of niches drilled partially through each block from a first face and a plurality of memorials etched into a second face opposite to the first face, each memorial on a portion of each block in front of one of the niches; and at least one separate columnar columbarium unit comprising a six-sided columnar block of stone extending upward from a foundation and having six outer faces carved into the columnar block, said outer faces alternating between pairs of adjacent pre-drilled niches extending partially through the block and pairs of memorializations, and a central passage extending from a top surface of the columnar block to a bottom surface, wherein said central passage is connected to a fluid pump for dispensing fluid out of the top surface.

2. The system according to claim 1, wherein the plurality of interconnected above-ground columbarium units have a plurality of openings passing completely through from the first face to the opposing second face to enable viewing through the unit.

3. The system according to claim 2, wherein the at least one above-ground columbarium unit comprise a plurality of spacers separating the stacked blocks at a thickness equal to one of the stacked blocks.

4. The system according to claim 1, further comprising a plurality of support rods extending vertically from a top block of the unit down into a foundation, through each intervening block or spacer, said rods resisting overturning movement of the monolithic block while allowing rotation of a first above-ground columbarium unit relative to an adjacent second above-ground columbarium unit.

5. The system according to claim 4, wherein the at least one separate columnar interment unit further comprises a catchment reservoir proximate to the foundation for catching fluid dispensed via the pump for recirculation out of the top surface.

6. The system according to claim 1, wherein the at least one separate columnar columbarium unit further comprises at least one support rod extending from the top surface, through the entire columnar unit, down into the foundation.

7. The system according to claim 1, wherein the at least one separate columnar unit is comprised of a monolithic block of stone.

8. The system according to claim 1, wherein the at least one separate columnar unit is comprised of multiple stacked layers of six-sided blocks with matching orientation of niches and memorializations.

9. A system for the interment of cremated remains in a memorialization facility, the system comprising:

a first above-ground columbarium unit sitting on a first foundation comprising a vertical stack of blocks interspaced by spacers, each block of the stack having a first plurality of niches drilled partially therethrough for receiving cremated remains and a plurality of memorials etched onto a portion of the block opposite to the first plurality of niches, each one of the first plurality of memorials in front of one of the niches;

a second above-ground columbarium unit sitting on a second foundation proximate to the first foundation, the second above-ground columbarium unit comprising a second vertical stack of blocks interspaced by spacers, each block of the second unit comprising a second plurality of niches drilled partially therethrough for receiving cremated remains and a second plurality of memorials etched onto a portion of the second block opposite to the first plurality of niches, each one of the second plurality of memorials centered over one of the niches, wherein respective blocks of the first and second above-ground interment units are interleaved with at least one support rod passing through the first and second units where they are interleaved into one of the foundations to prevent them from tipping over while allowing one above-ground columbarium unit to be rotated relative to the other above-ground columbarium unit.

10. The system according to claim 9, wherein at least one of the first and second units comprises a plurality of openings passing from the niche side to the memorial side of the unit to enable unobstructed viewing of the memorialization facility, said openings resulting from the spacers and interleaved blocks.

11. The system according to claim 9, further comprising at least one separate columnar columbarium unit comprising a six-sized columnar block extending upward from a corresponding foundation and having six vertical faces carved therein, said six vertical faces alternating between adjacent pre-drilled tubular niche pairs extending partially through the monolithic block and pairs of memorials, and having an central vertical passage extending from a top surface of the columnar block to a bottom surface, wherein said central passage is connected to a fluid pump for dispensing fluid out of the top surface.

12. The system according to claim 11, further comprising a catchment basin below said columnar columbarium unit, proximate to the foundation, for catching fluid running from the top of the unit down along the outer surfaces for recirculation via the fluid pump.

13. The system according to claim 11, further comprising at least one vertical support extending from a top surface of the of the columnar interment unit through the entire unit down into the foundation for preventing the columnar interment unit from tipping over.

14. The system according to claim 11, wherein the at least one separate columnar unit is comprised of a monolithic block of stone.

15. The system according to claim 11, wherein the at least one separate columnar unit is comprised of multiple stacked layers of six-sided blocks with matching orientation of niches and memorials.

16. A modular above-ground columbarium unit comprising:

a plurality of elongated individual blocks stacked vertically and horizontally, each block having a pre-drilled niche starting on one end and a memorial on a second opposing end, and a transverse opening located at a distance $D_2$ from the memorial end, the transverse opening passing entirely through the block, wherein individual blocks are stacked vertically and horizontally so that their long surfaces touch and at least one support rod passes through the transverse opening of each block in each vertical stack of blocks, wherein the at least one support rod passes through the transverse opening of each block so that vertically adjacent blocks do not have the same distance $D_2$.

17. The modular above-ground columbarium unit according to claim 16, wherein each pre-drilled niche comprises a predrilled tubular void having a cover over the predrilled tubular void.

* * * * *